US008851851B2

(12) United States Patent
Moore

(10) Patent No.: US 8,851,851 B2
(45) Date of Patent: Oct. 7, 2014

(54) SUPER LOW NOISE FAN BLADES, AXIAL FLOW FANS INCORPORATING THE SAME, AND COMMERCIAL AIR COOLED APPARATUSES INCORPORATING SUCH AXIAL FLOW FANS

(75) Inventor: John D. Moore, Marceline, MO (US)

(73) Assignee: Moore Fans LLC, Marceline, MO (US)

( * ) Notice: Subject to any disclaimer, the term of this patent is extended or adjusted under 35 U.S.C. 154(b) by 715 days.

(21) Appl. No.: 13/066,079

(22) Filed: Apr. 5, 2011

(65) Prior Publication Data

US 2011/0240268 A1 Oct. 6, 2011

Related U.S. Application Data

(60) Provisional application No. 61/321,127, filed on Apr. 5, 2010.

(51) Int. Cl.

| | |
|---|---|
| ***F04D 29/02*** | (2006.01) |
| ***F04D 29/66*** | (2006.01) |
| ***F04D 29/58*** | (2006.01) |
| ***F04D 29/38*** | (2006.01) |
| *F28B 1/06* | (2006.01) |

(52) U.S. Cl.

CPC ..... *F04D 29/582* (2013.01); *F28B 1/06* (2013.01); *F04D 29/663* (2013.01); *F04D 29/023* (2013.01); *F04D 29/384* (2013.01); *F28F 2250/08* (2013.01); *Y10S 416/50* (2013.01)

USPC ..... 416/204 R; 416/225; 416/228; 416/233; 416/238; 416/241 A; 416/500

(58) Field of Classification Search

CPC ... F04D 19/002; F04D 29/325; F04D 29/023; F04D 29/34; F04D 29/384; F04D 29/5826; F04D 29/663; F28B 1/06; F28F 2250/08

USPC ..... 416/204 R, 224, 225, 226, 228, 229 R, 416/232, 233, 238, 240, 241 R, 241 A, 500

See application file for complete search history.

(56) References Cited

U.S. PATENT DOCUMENTS 2,342,421 A 2/1944 Moore
3,575,524 A * 4/1971 Adajian ..... 415/224.5

(Continued)

FOREIGN PATENT DOCUMENTS

GB 2 062 120 A 5/1981

OTHER PUBLICATIONS

The International Search Report and the Written Opinion of the International Searching Authority dated Jul. 18, 2011, for International Application No. PCT/US2011/000618, filed Apr. 5, 2011.

(Continued)

*Primary Examiner* — Igor Kershteyn
(74) *Attorney, Agent, or Firm* — Christie, Parker & Hale, LLP

(57) ABSTRACT

Large diameter axial Super Low Noise flow fans and commercial air cooled apparatuses incorporating such fans are provided. The large diameter axial flow fan is mounted on the air cooled apparatus for generating an axial air flow in the air cooled apparatus for accomplishing the cooling. The fan has a diameter of at least four feet. The fan has plurality of blades. Each blade includes a leading edge opposite a trailing edge. The entire of the leading edge of each of the blades is linear and forward swept, and each blade includes a metallic outer surface.

26 Claims, 9 Drawing Sheets

(56) References Cited

U.S. PATENT DOCUMENTS

| | | | | |
|---|---|---|---|---|
| 6,086,330 | A | 7/2000 | Press et al. | |
| 6,113,353 | A * | 9/2000 | Sato et al. | 416/232 |
| 6,386,830 | B1 | 5/2002 | Slipper et al. | |
| 2004/0208746 | A1 | 10/2004 | Crocker | |
| 2011/0229330 | A1 * | 9/2011 | Spaggiari | 416/223 R |

OTHER PUBLICATIONS

Van Der Spek, Ir. Henk F.; Cooling Tower Institute, Reduction of Noise Generation by Cooling Fans (Report); Cooling Tower Institute Annual Meeting; New Orleans, Louisiana, Feb. 17-19, 1993.

Wright, T. et al.; Blade Sweep for Low-Speed Axial Fans; Journal of Turbomachinery (vol. 112/151); Department of Mechanical Engineering, University of Alabama, Birmingham, AL; Jan. 1990.

* cited by examiner

SUPER LOW NOISE FAN BLADES, AXIAL FLOW FANS INCORPORATING THE SAME, AND COMMERCIAL AIR COOLED APPARATUSES INCORPORATING SUCH AXIAL FLOW FANS

CROSS REFERENCE TO RELATED APPLICATION

This application is based upon and claims priority on U.S. Provisional Application Ser. No. 61/321,127 filed on Apr. 5, 2010, the contents of which are fully incorporated herein by reference.

BACKGROUND OF THE INVENTION

Large Super Low Noise commercial fans which are used in commercial air cooled apparatuses such as cooling towers, air cooled heat exchangers, including large radiator air coolers and air cooled steam condensers, have a diameter greater than four feet and have blades with forward swept concavely curved leading edges. The forward swept concave leading edges reduce the noise generated by such fan blades. A forward swept leading edge is a leading edge that in inclined at an angle in the direction of fan rotation. A typical fan 1 having blades 2 having a curved forward swept leading edge 3 is shown in FIG. 1. As can be seen the leading edges have a concave forward sweep 4. The forward swept concave leading edge fan blades provide for the quietest fans. Fans with such blades are referred commonly referred to as "Super Low Noise fans" or alternatively as "Ultra Low Noise fans". A description of such fan blades is provided in the article entitled "Blade Sweep of Low-Speed Axial Fans" by T. Wright and W. E. Simmons published in the January 1990 Journal of Turbomachinery, pages 151 to 158, and the paper entitled "Reduction of Noise Generation By Cooling Fans" by Ir. Henk F. Van der Spek, presented at the 1993 Cooling Tower Institute Annual meeting. These articles are fully incorporated herein by reference. These blades are typically fabricated from fiberglass with a polyester resin to allow easier molding into their complex shape. Moreover these blades are rigidly mounted to a fan hub. Consequently these Super Low Noise fans, which are currently the quietest available, are heavy and expensive to fabricate. Because of their weight, they are cumbersome to install, requiring cranes or heavy equipment, and unbalances can generate substantial loads on the supporting structure and bearings which can lead to structural failure and/or reduced fan bearing life.

SUMMARY OF THE INVENTION

In an exemplary embodiment large diameter axial flow fans and commercial air cooled apparatuses incorporating such fans are provided. In an exemplary embodiment, a large diameter axial flow fan is mounted on an air cooled apparatus for generating an axial air flow in the air cooled apparatus for accomplishing the cooling. The fan has a diameter of at least four feet. The fan has plurality of blades. Each blade includes a leading edge opposite a trailing edge. The entire of the leading edge of each of the blades is linear and forward swept, and each blade includes a metallic outer surface. The fan is a Super Low Noise fan. In a further exemplary embodiment, the commercial air cooled apparatus is selected from the group of air cooled apparatuses consisting of air cooled heat exchangers, radiator coolers, air cooled steam condensers, and cooling towers. In one exemplary embodiment, each blade leading edge is forward swept at an angle of 25° as measured from a radius of rotation of the blade. In another exemplary embodiment, the each of the blades is made from sheet metal stressed skin. In a further exemplary embodiment, the sheet metal is aluminum. In yet another exemplary embodiment, the fan has a diameter of at least 9, 10, 11, 12, 13, or 14 feet. In yet a further exemplary embodiment, the fan has at least three blades and in another exemplary embodiment the fan has at least four blades. In a further exemplary embodiment, the fan includes a hub and the blades are resiliently mounted to the hub. In another exemplary embodiment, each blade is filled with foam. In yet another exemplary embodiment, the entire trailing edge of each blade is linear. In yet a further exemplary embodiment, each blade has a length of 42 inches. In another exemplary embodiment each blade has a length of 48 inches. In yet another exemplary embodiment, each blade has an average chord length of 48 inches. In yet a further exemplary embodiment, the fan generates a sound power level in dBA. Such power lever may be determined by the following equation:

$$PWL=C+30*\log_{10}(TS/1000)+10*\log_{10}(HP)+\text{Add}$$

Where:

PWL=Fan Sound Power Level in dBA

C=Fan baseline noise level in dBA which is a function of blade design

TS=Fan tip speed in ft/minute which is equal to π*Fan RPM*Fan Diameter

HP=Fan Shaft Horsepower

Add=Additional noise due to entry and installation effects.

In one exemplary embodiment C for the fan is not greater than 45 dBA. In another exemplary embodiment C for the fan is in the range of 43 to 45 dBA. In yet another exemplary embodiment C for the fan is in not greater than 43 dBA.

DETAILED DESCRIPTION

Figure 2A:
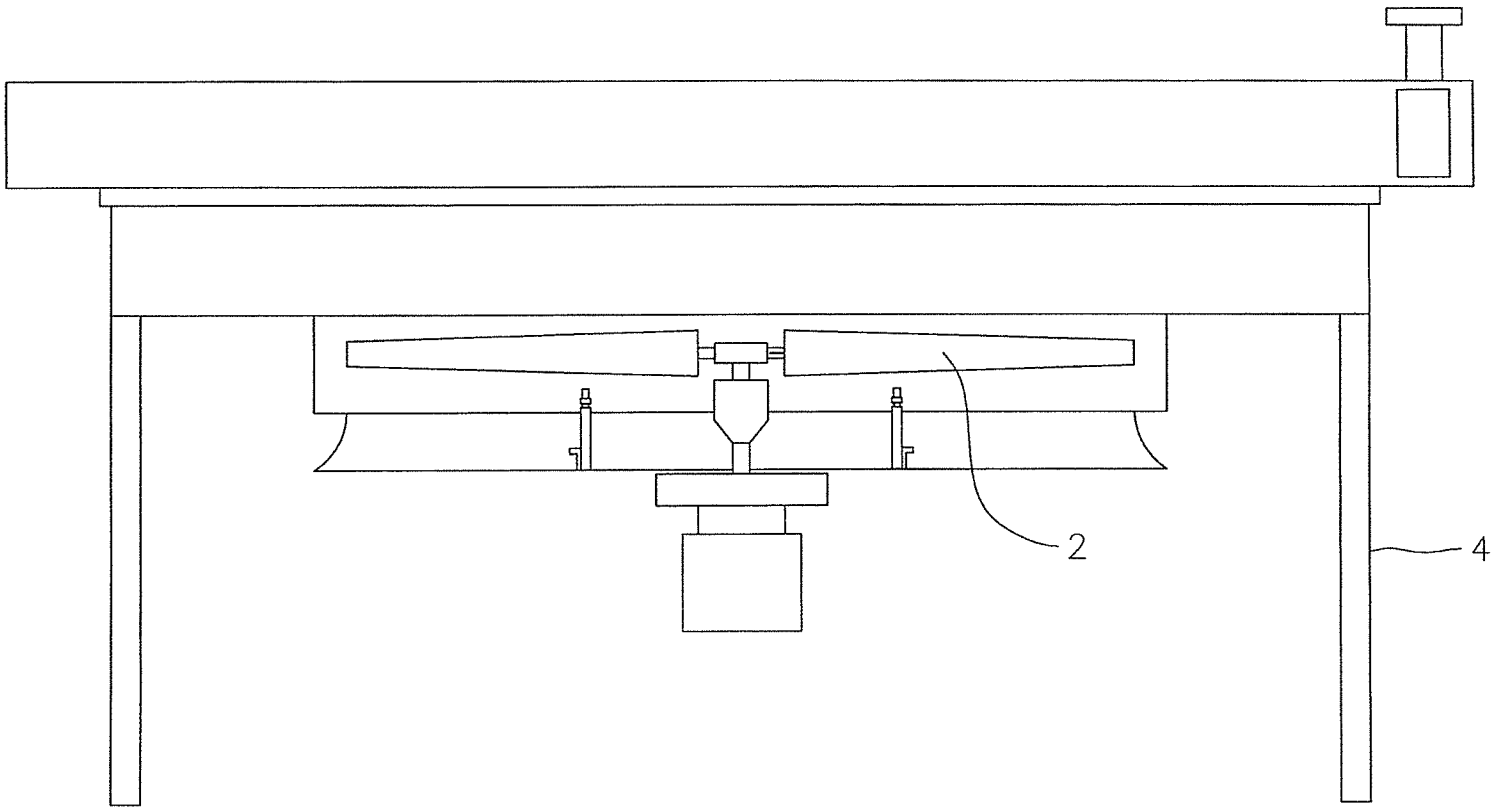
FIGS. 2A, 2B, 2C, and 2D are schematic views of an air cooled heat exchanger, a cooling tower, a large diameter radiator cooler, and an air cooled steam condenser, respectively, incorporating an exemplary embodiment Super Low Noise fan of the present invention.
Figure 2B:
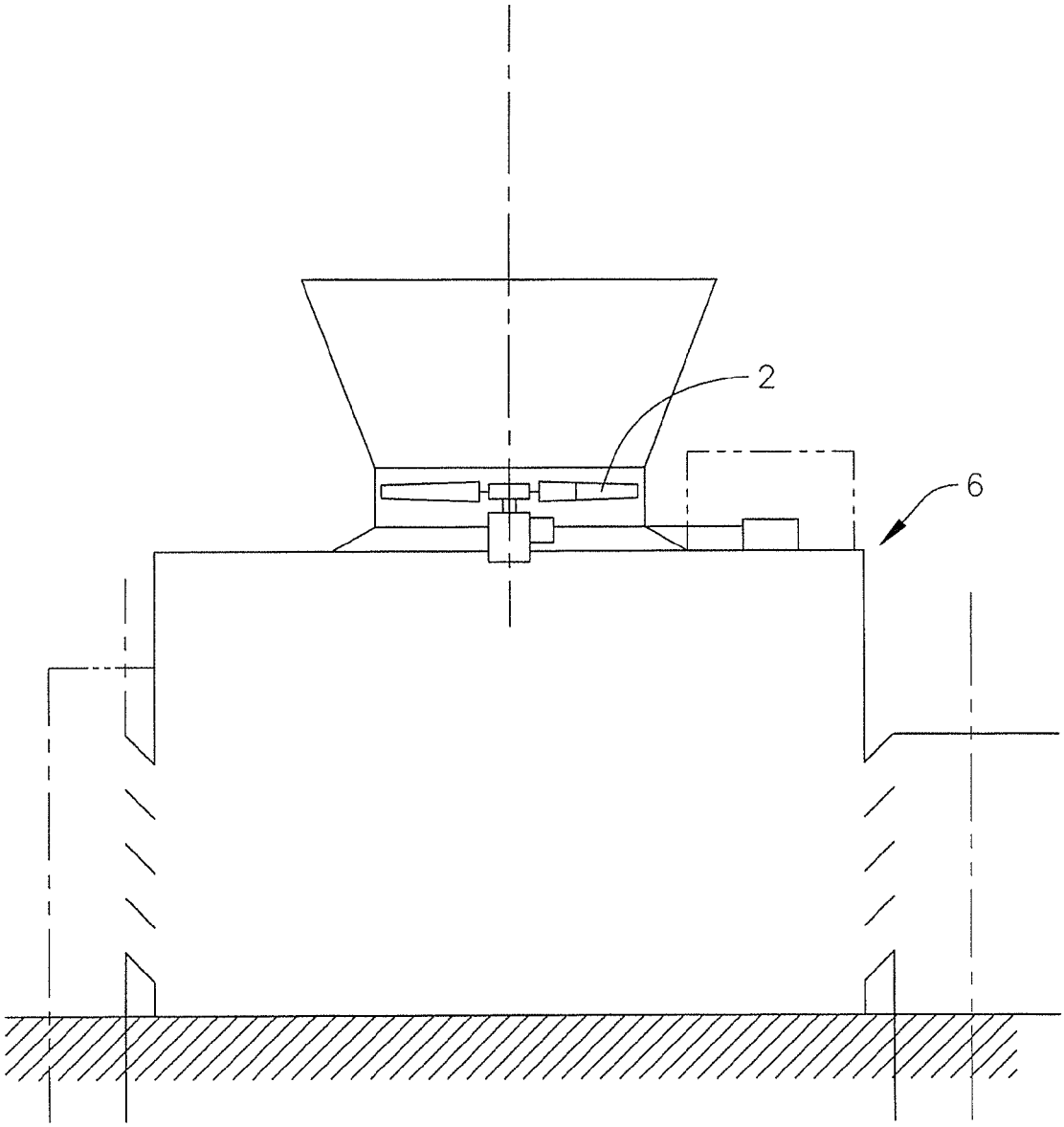
Figure 2C:
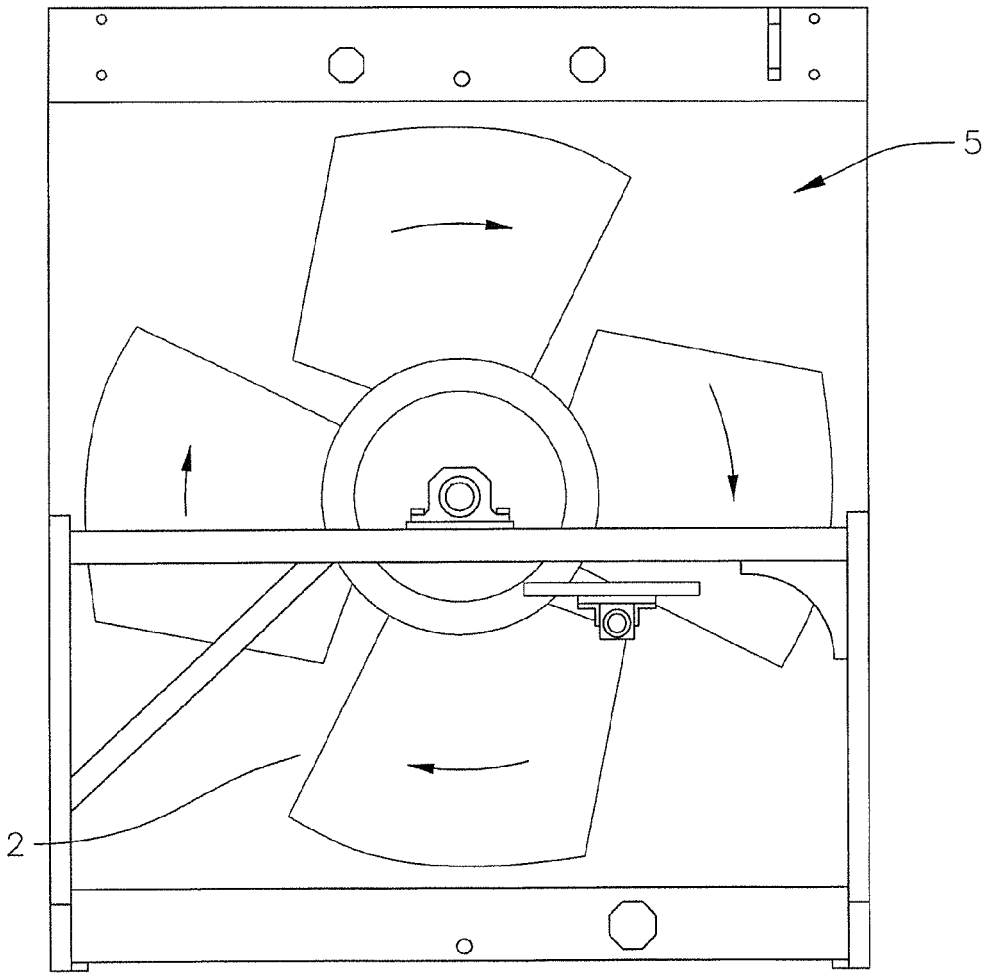
Figure 2D:
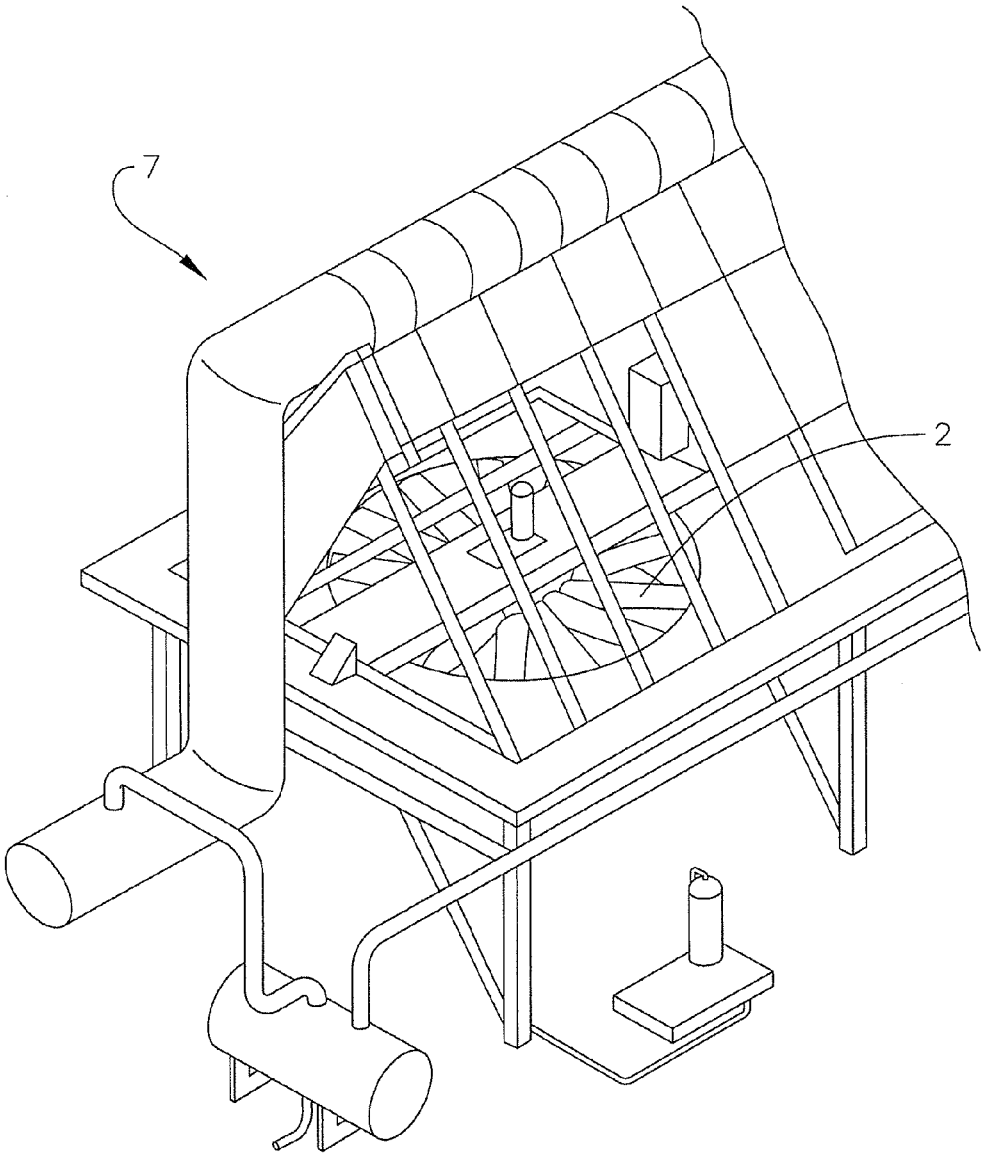
Figure 4:
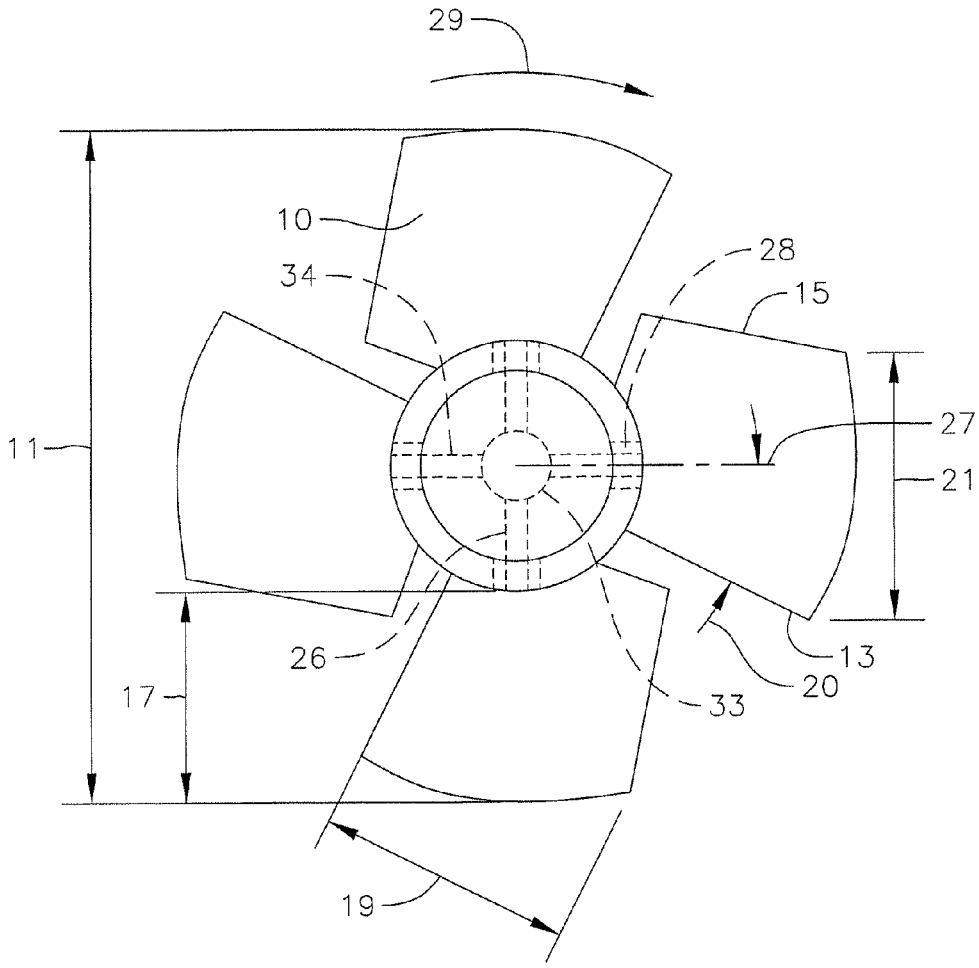
FIG. 4 is a top view of an exemplary embodiment Super Low Noise fan of the present invention incorporating the exemplary embodiment blades of the present invention.

The present invention provides for axial flow Super Low Noise fans 2 for commercial (e.g., industrial) applications for use in commercial (e.g., industrial) air cooled apparatuses such as air cooled air heat exchangers 4 and cooling towers 6 (FIGS. 2A and 2B) and for commercial air cooled apparatuses incorporating such fans. An air cooled apparatus is an apparatus that uses air to accomplish a cooling of a fluid or to accomplish a cooling of another structure. "Air cooled apparatuses" as used herein also include apparatuses that use air for heating a fluid or another structure. Large radiator air coolers 5 (FIG. 2C) which may be used in commercial applications and in engine cooling applications, and air cooled steam condensers 7 (FIG. 2D) are considered to also be air cooled heat exchangers and are part of the inventive air cooled apparatuses incorporating the inventive fans. Air cooled heat exchangers and cooling towers are well known in the art and thus are not described herein. The inventive fans have linearly forward swept blades and diameters not less than four feet and up to 14 feet or even greater. In exemplary embodiments, the fans have resiliently mounted, forward swept, low noise blades fabricated from sheet metal. The exemplary embodiment blades have a leading edge 13 opposite a trailing edge 15 (FIG. 4). The entire leading edge 13 is linearly forward swept. In more specific exemplary embodiments, the inventive fans have diameters 11 (FIG. 4) of 9, 10, 11, 12 and 13 feet. Applicant has produced and tested at least the 10 foot exemplary fans for noise and performance and has discovered to have the noise and performance comparable to existing Super Low Noise fans which have a curved forward swept leading edge. This was an unexpected result, as fans incorporating blades having a metal skin are noisier than comparable fans having blades having a composite material skin and because all the teachings indicate that fans having blades having a concavely curved leading edge are the quietest fans.

Fan noise of large diameter fans, i.e., fans having a diameter of at least four feet, such as the fans of the present invention used in air cooled heat exchangers and in cooling towers is influenced by many factors. The noise generated by a fan may be predicted from the following equation:

$$PWL=C+30*\log_{10}(TS/1000)+10*\log_{10}(HP)+\text{Add}$$

Where:

PWL=Fan Sound Power Level in dBA

C=Fan baseline noise level in dBA which is a function of blade design

TS=Fan tip speed in ft/minute which is equal to π*Fan RPM*Fan Diameter

HP=Fan Shaft Horsepower

Add=Additional noise due to entry and installation effects (e.g., obstructions, and inlet conditions).

From this equation it can be seen that fan tip speed and horsepower are strong drivers for fan noise, so even older generation fans can be quieted to a certain extent by lowering the fan horsepower and or tip speed. However, when comparing the noise level of two operating fans, having the same dimensions and operating with the same criteria and in the same environment, the variable that determines the overall noise (i.e., the PWL) generated by such fans is "C".

Figure 1:
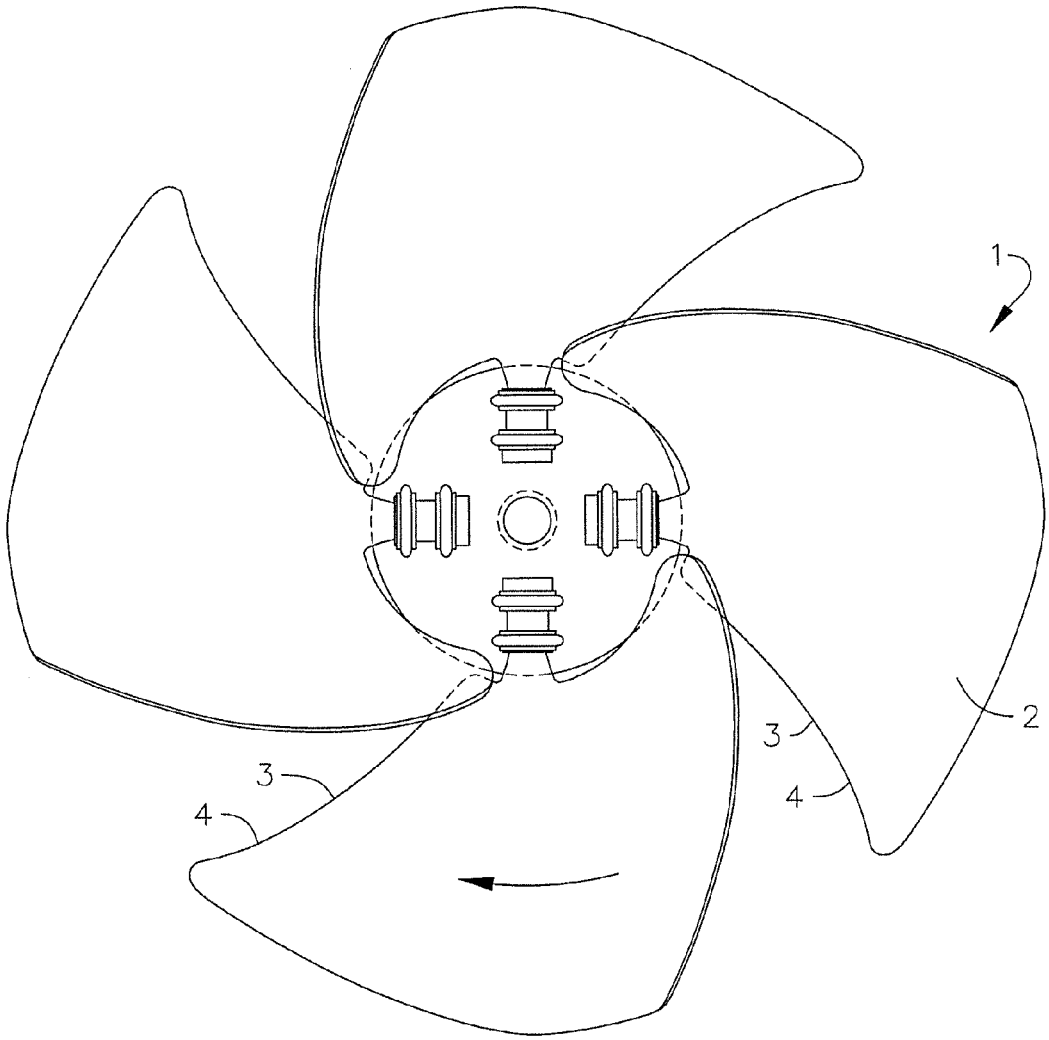
FIG.1 (PRIOR ART)
FIG. 1 is a top view of the a conventional concave forward swept Super Low Noise fan.

For older, narrow chord blades, "C" is typically 53-55 dB, while conventional Super Low Noise fans having a curved leading edge, such as the one shown in FIG. 1, "C" can be as low as 43-45 dBA. Thus for the same fan speed and horsepower, it is possible to achieve noise savings of up to 10 dBA by using conventional Super Low Noise fans over conventional fans having the same dimension and blades which do not have leading edges which are have a concave forward sweep. The exemplary embodiment fans incorporating the exemplary embodiment blades which have a leading edge which is entirely linearly forward swept also have a "C" value as low as 43-45 dBA and even lower. Thus, the inventive fans produce the same noise as the conventional Super Low Noise fans, and even lower noise.

Figure 3:
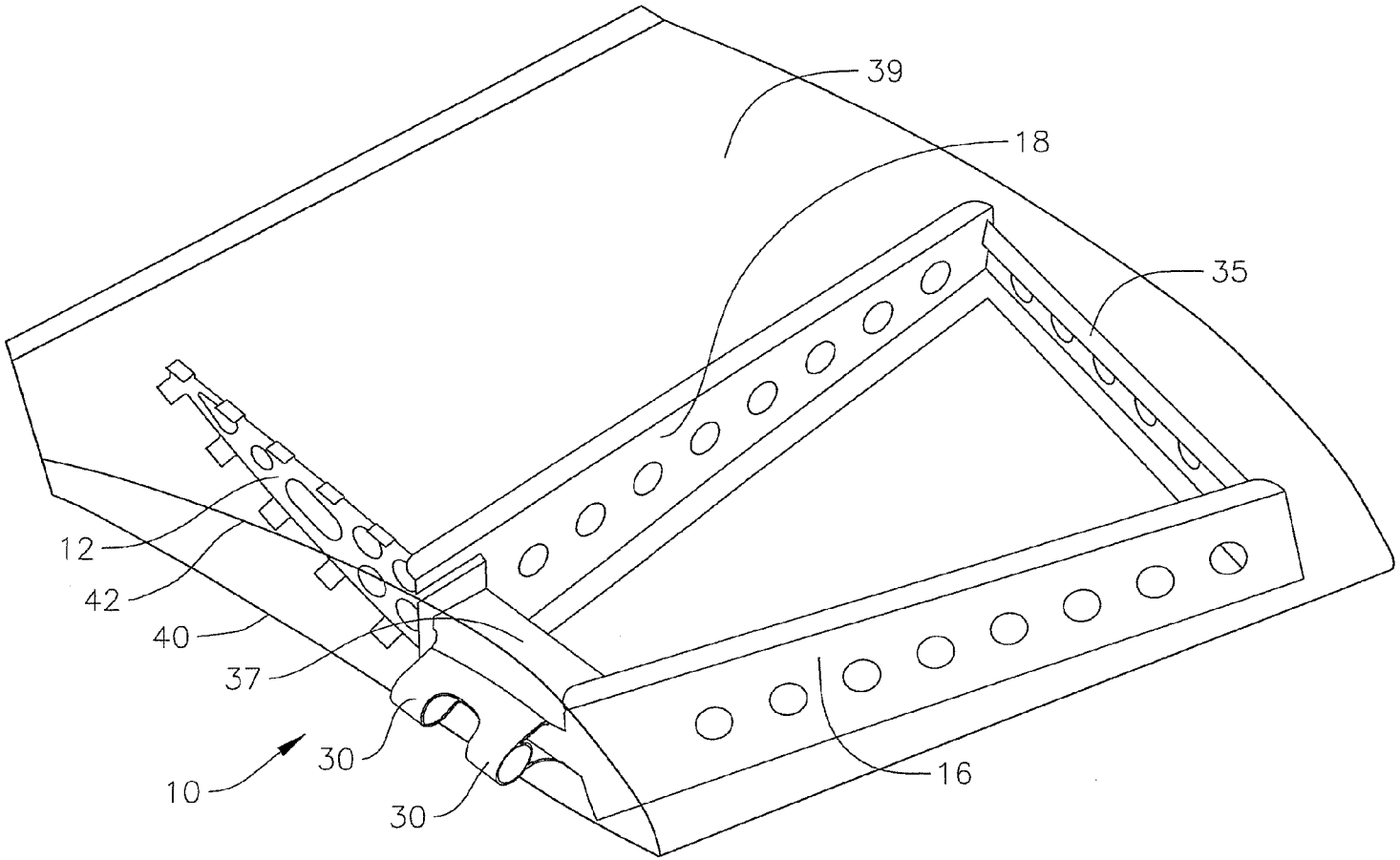
FIG. 3 is a perspective schematic view of an exemplary embodiment blade of the present invention with the skin shown as transparent for showing the ribs and spars of the blade.

In an exemplary embodiment, each forward swept blade 10 includes a rib, as for example rib 12 shown in FIG. 3, as well as a forward spar 16 and a rear spar 18. In an exemplary embodiment, the forward spar 16 is generally C-shaped in cross-section, while the rear spar 18 is generally Z-shaped in cross section. The two spars are interconnected with a connecting spar 35 at the far end of the spars. In an exemplary embodiment the connecting spar 35 also has a C-shaped cross-section. At the root end, the forward and rear spars are interconnected with a mounting block 37 having hinge arms 30. In an exemplary embodiment the connecting spar is riveted and the mounting block is bolted to the forward and rear spars. In another exemplary embodiment, the connecting spar and the mounting block may be welded or otherwise attached to the forward and rear spars. In an exemplary embodiment, each forward swept blade of the present invention is linearly swept, i.e., it has a leading edge 13 that is entirely linearly forward swept in the direction 29 of fan rotation at an angle 20 of about 25° as measured from a radius of rotation 27 of each blade, i.e., the radius along which the blade is attached to the hub (FIG. 4). In an exemplary embodiment, the entire trailing edge of the blades is also linear. The exemplary blades are mounted on a hub, such as hub 26 shown in FIGS. 4 and 5, using resilient bushings 28. The resilient bushings 28 are fitted into the hinge arms 30 which straddle the ends 32 of radial spokes 34 extending from a central hub 33. The central hub 33 and the radial spokes 34 form the overall hub 26. With this resilient mounting, the blades are able to have at least some up/down rotational movement relative to the hub.

Figure 5:
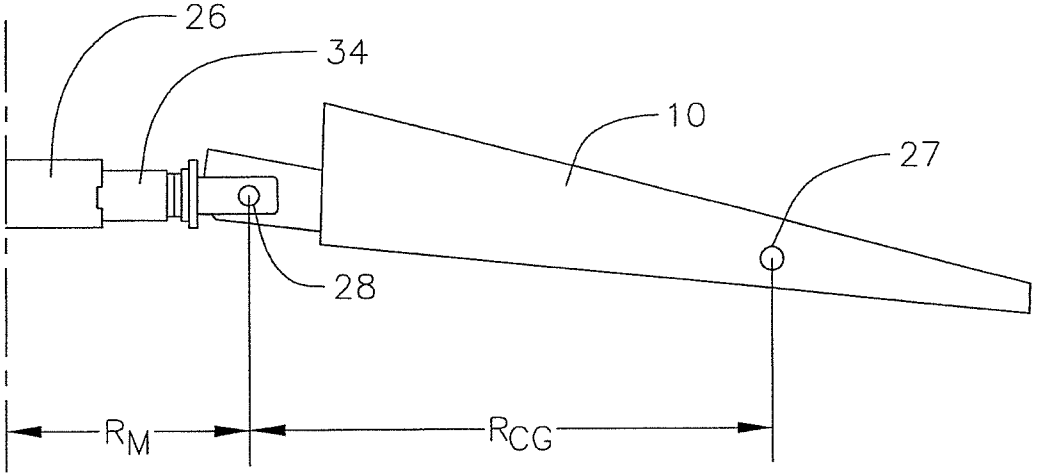
FIG. 5 is a partial end view of a fan of the present invention depicting a blade resiliently mounted on a hub.

The resilient mounting, which is known in the art, is such that it eliminates first mode resonant frequencies. FIG. 5 shows a hub/blade/pivot arrangement typical of an exemplary embodiment fan in operation. The pivot 26 is located at a radial distance $R_M$ from the center or rotation $C_L$. The center of gravity 27 of the blade is located at a radial distance $R_{CG}$ from the pivot. It can be shown that the blade resonant frequency ($f_N$) is related to the fan rotation frequency (f) as follows:

$$f_N=f((R_M+R_{CG})/R_{CG})^{1/2}$$

As can be seen from the equation above, the blade resonant frequency is always higher than the blade rotational speed. The blade resonant frequency will only coincide with the rotation frequency if the mount radius $R_M$ were equal to zero, which is not the case with the exemplary embodiment fans. The resonant frequency varies along with the rotation speed (i.e. rotation frequency) remaining a fixed percentage away. This allows the exemplary fans to operate with variable speed drives without the rotational frequency ever being equal to the resonant frequency which can lead to early structural failures.

In an exemplary embodiment, 9, 10, 11, 12, or 13 feet diameter fans are provided using the exemplary embodiment blades. With these exemplary fans, four exemplary embodiment blades are incorporated. In other exemplary embodiment, the exemplary fans have three blades. In yet other exemplary embodiments, the fans may have more than four blades. In another exemplary embodiment, 14 feet diameter fans are provided with the exemplary embodiment blades. The 14 feet diameter fans in one exemplary embodiment are provided with four blades. In another exemplary embodiment, they are provided with six blades.

The exemplary embodiment blades having a diameter in the range of 9 to 13 feet incorporate in one embodiment four blades each having a length 17 of 42 inches and an average chord length 19 of 48 inches (FIG. 4). The overall diameter of the fan is varied by using a hub 26 having a different diameter 21. Thus, for example, a 10-foot diameter fan will have a hub being one foot greater in diameter than a 9-foot diameter fan. In other exemplary embodiments, the fan blades 10 have a length 17 of 48 inches and an average chord length 19 of 48 inches.

Figure 6:
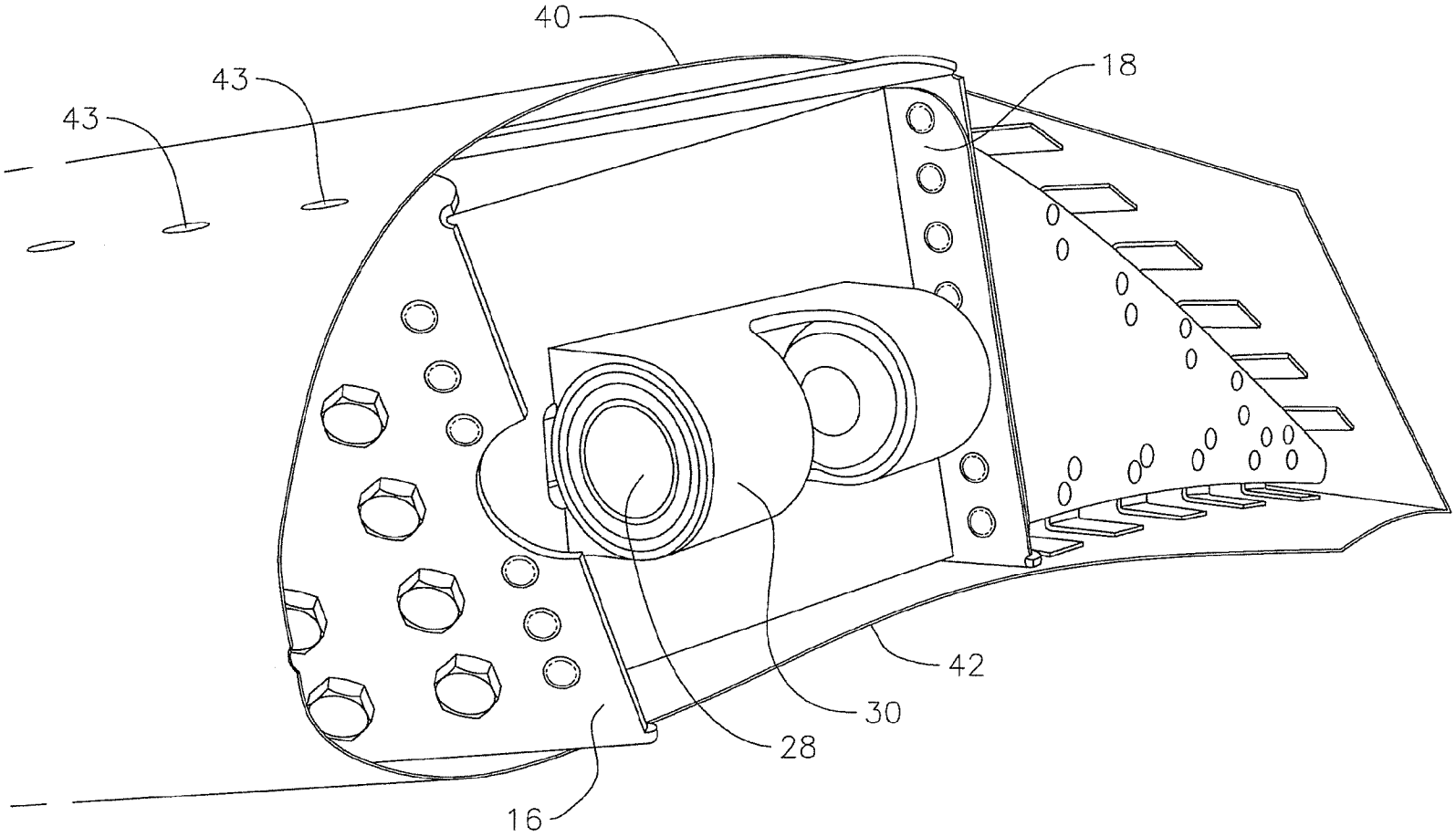
FIG. 6 is a perspective end view of a mounting side of a blade of the present invention.

The exemplary blades are formed using sheet metal stressed skin. In an exemplary embodiment, the sheet metal stressed skin is 5052 high grade marine alloy aluminum. Sheet metal stressed skin is used to form the outer surface or skin 39 of each blade, as well as the spars 16, 18 and ribs 12, as for example shown in FIG. 6. In an exemplary embodiment, a sheet of metal stressed skin is wrapped around the ribs to form the blade outer skin with an upper concave surface 40 and a lower convex surface 42, as for example shown in FIGS. 4 and 6. Spot welding 43 and rivets are used to attach the skin to the ribs and spars as necessary. Spot welding may be accomplished using automated robotic spot welders. In an exemplary embodiment, the blade as defined by its outer surface 39 is filled with high density foam. Exemplary foams include polyurethane foams having a density of about 2 lbs/$ft^3$. Applicant's testing has shown that the foam makes the fan quieter. The exemplary embodiment blades having linear leading and trailing edges are easier to manufacture using a sheet metal as the sheet metal can be easily bent and formed to define the leading and trailing linear edges, thus reducing manufacturing costs. In addition, they are lighter in weight than the conventional Super Low Noise fans, such as the one shown in FIG. 1, formed from composite materials.

The exemplary embodiment fans are lighter and produce less vibration than current Super Low Noise fans of the same diameter operating under the same environment and parameters, e.g. rpm. Consequently, use of the exemplary embodiment fans reduce the stress on and transmitted through the drive mechanism and structure, thus prolonging the operating lives of such mechanisms and structures. Moreover, the exemplary embodiment fans reduce the bending loads provided to the drive mechanism and structure than the conventional Super Low Noise fans. Their installation is also easier than conventional Super Low Noise fans.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should include not only the embodiments disclosed but also such combinations of features now known or later discovered, or equivalents within the scope of the concepts disclosed and the full scope of the claims to which applicants are entitled to patent protection.

What is claimed is:

1. A commercial air cooled apparatus and a large diameter axial flow fan combination comprising:

said commercial air cooled apparatus generating an air flow for cooling; and said large diameter axial flow fan being mounted on said air cooled apparatus for generating said air flow in said air cooled apparatus for said cooling, said fan having a diameter of at least four feet, said fan comprising a plurality of blades, wherein each of said blades comprises a leading edge opposite a trailing edge, wherein the entire of said leading edge of each of said blades is linear and forward swept, and wherein each blade comprises a metallic outer surface over a forward spar, a rear spar and a connecting spar interconnecting the forward and rear spars, wherein said fan is a super low noise fan.

2. The combination of claim 1, wherein the commercial air cooled apparatus is selected from the group of air cooled apparatuses consisting of air cooled heat exchangers, radiator coolers, air cooled steam condensers, and cooling towers.

3. The combination of claim 1, wherein each of the blades is made from sheet metal stressed skin.

4. The combination of claim 3, wherein said sheet metal is aluminum.

5. The combination of claim 1, wherein the fan has a diameter of at least 9 feet.

6. The combination of claim 1, wherein the fan has a diameter of at least 10 feet.

7. The combination of claim 1, wherein the fan has a diameter of at least 11 feet.

8. The combination of claim 1, wherein the fan has a diameter of at least 12 feet.

9. The combination of claim 1, wherein the fan has a diameter of at least 13 feet.

10. The combination of claim 1, wherein the fan has a diameter of at least 14 feet.

11. The combination of claim 1, wherein the fan has at least 3 blades.

12. The combination of claim 1, wherein the fan has at least four blades.

13. The combination of claim 1, wherein the fan comprises a hub, and wherein the blades are resiliently mounted to the hub.

14. The combination of claim 1, wherein each blade is filled with foam.

15. The combination of claim 1, wherein the entire trailing edge of each blade is linear.

16. The combination of claim 1, wherein each blade has a length of about 42 inches.

17. The combination of claim 1, wherein each blade has a length of about 48 inches.

18. The combination of claim 1, wherein each blade has an average chord length of about 48 inches.

19. The combination of claim 1, wherein the fan sound power level in dBA is determined as follows:

$$PWL=C+30*\log_{10}(TS/1000)+10*\log_{10}(HP)+\text{Add}$$

where:

PWL=Fan Sound Power Level in dBA

C=Fan baseline noise level in dBA which is a function of blade design

TS=Fan tip speed in ft/minute which is equal to π*Fan RPM*Fan Diameter

HP=Fan Shaft Horsepower

Add=Additional noise due to entry and installation effects wherein C for the fan is not greater than 45 dBA.

20. The combination of claim 19, wherein C for the fan is in the range of 43 to 45 dBA.

21. The combination of claim 19, wherein C for the fan is in not greater than 43 dBA.

22. The combination of claim 1, wherein each blade leading edge is forward swept at an angle of 25° as measured from a radius of rotation of such blade.

23. The combination of claim 1, wherein said forward spar is spaced apart from said rear spar.

24. The combination of claim 23, wherein the forward spar is forward swept.

25. The combination of claim 1, wherein the metallic outer surface comprises a first surface portion extending between said forward and rear spars opposite a second surface portion extending between said forward and rear spars, wherein the first surface portion is concave and the second surface portion is convex.

26. The combination of claim 1, wherein the trailing edge of each blade is linear.

* * * * *